United States Patent [19]

Smith, Jr.

[11] 4,421,353

[45] Dec. 20, 1983

[54] PALLET PULLER

[76] Inventor: James P. Smith, Jr., 630 Masonic Way, Apt. B, Belmont, Calif. 94002

[21] Appl. No.: 149,231

[22] Filed: May 12, 1980

[51] Int. Cl.[3] ..... B66C 1/48

[52] U.S. Cl. ..... 294/82 R; 294/26; 294/116

[58] Field of Search ..... 294/82 R, 104, 116, 294/106, 118, 99 R, 86 R, 19 R, 26, 16, 28; 24/248 R; 414/620, 621

[56] References Cited

U.S. PATENT DOCUMENTS

| | | | |
|---|---|---|---|
| 2,507,058 | 5/1950 | Stone | 294/104 |
| 2,817,556 | 12/1957 | White | 294/116 |
| 3,073,616 | 1/1963 | Bergstrom, Jr. | 294/86 R |
| 3,727,966 | 4/1973 | Stockwell | 294/82 R |
| 3,756,096 | 9/1973 | Bolden | 294/19 R |
| 3,761,121 | 9/1973 | Reid | 294/19 R |
| 3,807,786 | 4/1974 | Alegria | 294/104 |
| 4,094,544 | 6/1978 | Spaine | 294/82 R |
| 4,098,533 | 7/1978 | Hanlon, Jr. | 294/116 |
| 4,114,941 | 9/1978 | Heaton | 294/86 R |

*Primary Examiner*—James B. Marbert
*Attorney, Agent, or Firm*—Thomas H. Olson

[57] ABSTRACT

A pallet puller for effecting engagement with a cargo pallet for sliding the same over a vehicle bed or like surface. In one form there are two pivotally mounted arms having cross pieces on their inner end. The cross pieces have lateral protrusions that fit beneath the stringer in the pallet so as to retain the pallet puller in place under virtually all conditions. There is mechanism for controllably pivoting the two arms between an open position and a closed position. In another form there is a single elongate arm with a cross piece on the end. The cross piece has lateral protrusions that fit beneath the pallet stringer to retain the pallet puller in place.

11 Claims, 8 Drawing Figures

Fig_4
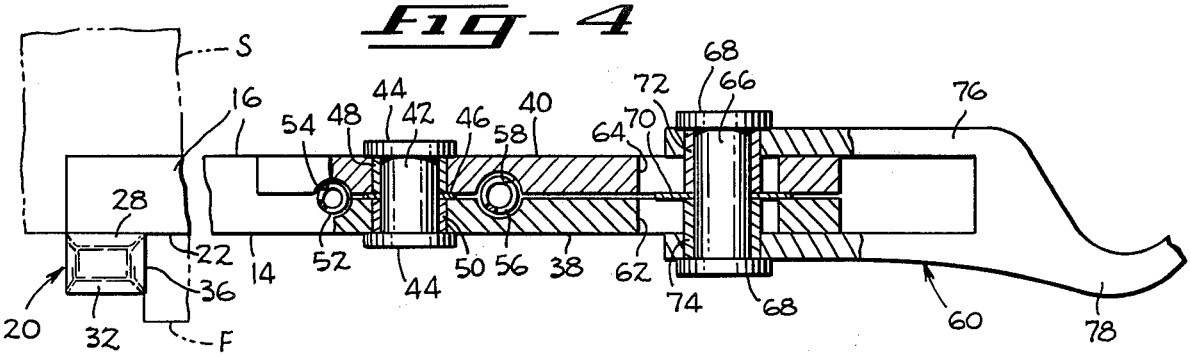
Fig_5
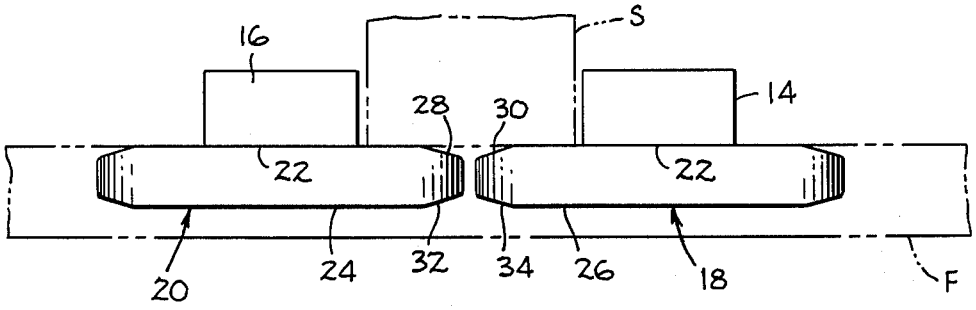
Fig_6
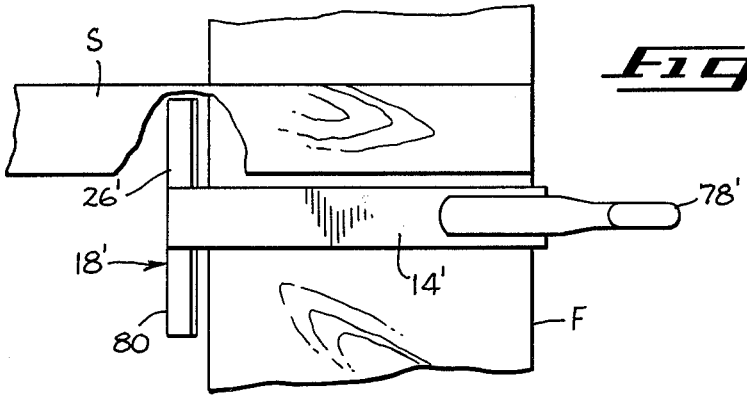
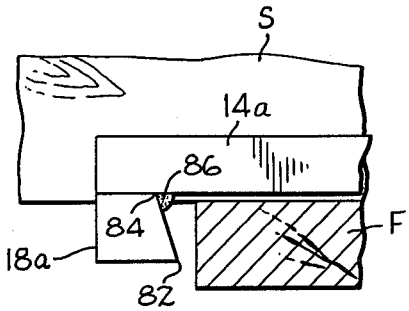
Fig_7
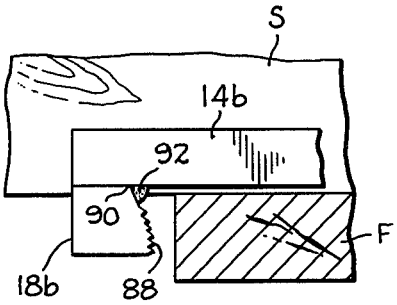
Fig_8

PALLET PULLER

BACKGROUND OF THE INVENTION

1. Field of the Invention

This invention relates to apparatus for engaging a cargo pallet and more particularly to such apparatus useful for engaging a pallet for slidably pulling the pallet over a surface.

2. Description of the Prior Art

In unloading palletized loads from transport vehicles at sites lacking a surface level with the bed of the transport vehicle, it is necessary that the pallets be slid or pulled on the vehicle bed surface to a point sufficiently close to the door of the vehicle that a fork lift truck can pick up the pallet. Because of the substantial weight of a typical palletized load, the frictional force between the pallet and the vehicle bed surface is such that power equipment is needed to slide the pallet to a point near the vehicle door. It is necessary that some means be provided for permitting the power equipment to engage the pallet, and numerous engaging means are disclosed in the prior art.

One form of engaging means has teeth which dig into the pallet stringer to afford a grip thereon. The pallet puller disclosed in U.S. Pat. No. 3,807,786 exemplifies this form of gripping device. Such gripping device can damage the pallet by breaking the wood members of which it is formed and can become inadvertently disengaged from the pallet during a pulling operation.

Another form of pallet engaging device includes a hook adapted to engage the foot boards that form the bottom of the pallet. Such hook devices are disclosed in U.S. Pat. Nos. 3,073,613; 3,727,966; 4,094,544 and 4,114,941. These hook devices are less likely to subject the pallet to damage but are prone to disengage from the pallet, particularly when tension on a chain or cable extending from the engaging means to the vehicle is temporarily interrupted.

SUMMARY OF THE INVENTION

A pallet puller according to the invention includes an elongate rigid member that fits within the space between the upper and lower pallet surfaces. On the inner end of the elongate member is a cross piece which is adapted to engage the inner edge surface of the pallet foot board and has a portion that extends beneath a stringer that extends transversely of the foot board. Thus, the pallet is firmly engaged, and even should tensile forces on the pallet puller be temporarily interrupted, the pallet puller remains engaged because the cross piece is beneath the stringer.

An object of the invention is to provide a pallet puller that is virtually immune to inadvertent disengagement from a pallet. This object is achieved by providing the above noted cross pieces which extend beneath the stringer thereby positively retaining the pallet puller in engagement with the pallet.

A further object is to provide a pallet puller which can engage with the center of one side of the pallet so as to permit sliding movement of the pallet in a predictable direction. This object is achieved in accordance with the invention by providing two pivotally mounted elongate arms, each of which has on its inner end a cross piece that projects from the inner end of the respective arm by a distance no greater than one half of the thickness of the pallet stringer. Because a typical pallet has a stringer in the center thereof, a pallet puller installed symmetrical of the central stringer assures application of tensile forces at the center of one edge of the pallet whereby the direction in which the pallet slides on the vehicle bed is predictable and controllable.

A further object of the invention is to provide a pallet puller which is rugged and virtually indestructible. Equipment used in unloading vehicles is subject to hard use and at times abuse. A pallet puller according to the present invention is constructed so that any parts thereof having relative fragility are protected by high strength externally exposed members.

The foregoing together with other objects, features and advantages will be more apparent after referring to the following specification and the accompanying drawings.

BRIEF DESCRIPTION OF THE DRAWINGS

FIG. 4 is a cross sectional side view of the pallet puller of FIG. 3 with portions being broken away to reveal internal details.

FIG. 5 is a view taken along line 5—5 of FIG. 3 showing the pallet puller engaged with the pallet.

FIG. 6 is a top view of an alternate form of pallet puller embodying the invention.

FIG. 7 is a fragmentary view at enlarged scale showing one configuration of a cross piece for engaging the pallet foot board.

FIG.8 is a view similar to FIG. 7 showing an alternate form of the pallet engaging cross piece.

DETAIL DESCRIPTION OF A PREFERRED EMBODIMENT

Figure 1:
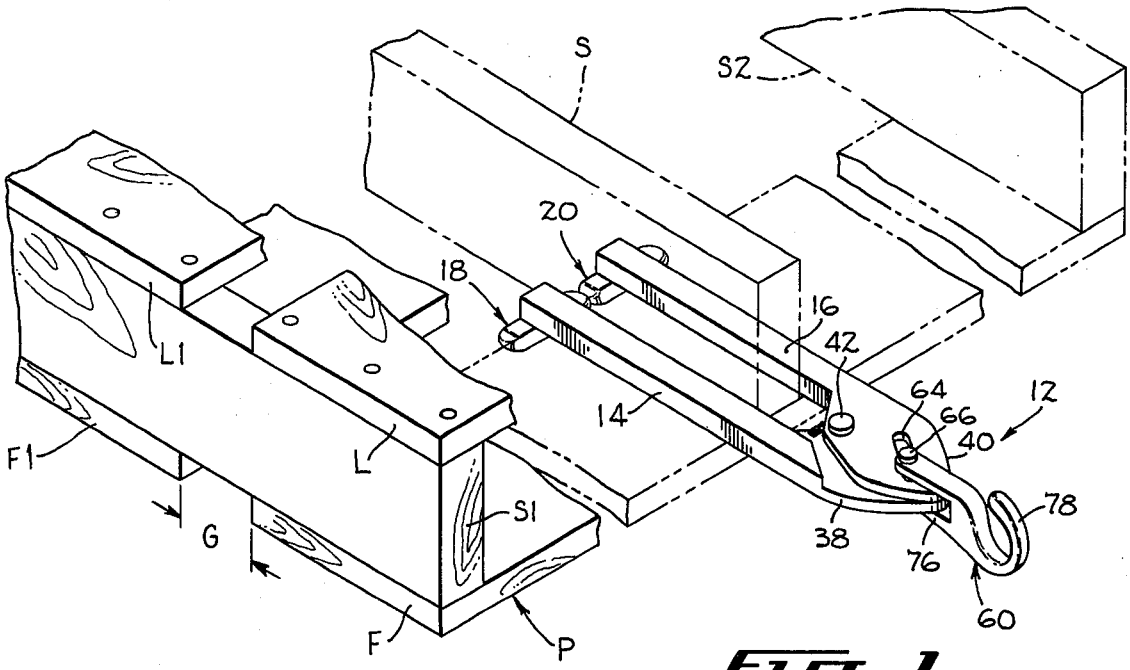
FIG. 1 is a perspective view of one form of pallet puller according to the invention shown in engagement with a pallet.

Referring more particularly to the drawings and to FIG. 1, a conventional pallet P includes a plurality of foot boards, two such foot boards being shown at F and F1. Extending transversely of foot boards F and F1 are stringers S, S1 and S2. Conventional practice is for the foot boards to be fastened to the stringer by means of nails or screws. Extending across the top surfaces of the stringers are load supporting boards, two of which are indicated at L and L1. Typically, the foot boards and the load supporting boards are formed of nominal 1 inch lumber and stringers are formed of nominal 2 inch lumber. The stringers are installed on their edges so as to define a space between the foot boards and the load supporting boards which space corresponds to the vertical dimension of the stringers. As is known, conventional practice is for the tines of a fork lift to be introduced into the space when it is desired to lift the pallet and the load supported thereon. Typically the foot boards are spaced from one another so as to define a gap G therebetween.

One form of pallet puller embodying the invention is indicated at 12. The pallet puller includes first and second substantially identical elongate arms 14 and 16. Elongate arms 14 and 16 have inner ends to which are respectively fixed cross pieces 18 and 20. Referring to FIG. 5, each of elongate arms 14 and 16 includes a surface 22 adapted to reside on the upper surface of foot board F. Cross pieces 18 and 20 are secured to such surfaces of the respective arms by means of riveting, welding, or any other suitable expedient.

Cross pieces 18 and 20 extend transversely of the respective elongate arms to which they are attached; cross piece 20 has an inward extending projection 24 and cross piece 18 has an inward extending projection 26. As can be seen in FIG. 5, inward extending projections 24 and 26 each has a length no greater than one half the thickness of stringer S so that both cross pieces can fit within gap G beneath the lower surface of the stringer. The ends of inward extending projections 24 and 26 have upper tapered surfaces 28 and 30, respectively, and lower tapered surfaces 32 and 34, respectively. The taper formed at the outer end of projections 24 and 26 facilitates entry of the cross pieces beneath the lower surface of stringer S. As can be seen most clearly in FIG. 4, cross piece 20, which also exemplifies cross piece 18, has a gripping portion in the form of a flat gripping surface 36 which is perpendicular to surface 22 on elongate arm 16. The surface 36 engages the edge surface of foot board F so that when force is applied to elongate arm 16 in a direction toward the right as viewed in FIG. 4, surface 36 will bear against the edge surface of the foot board and move the pallet in the same direction. Also clearly seen in FIG. 4 is the fact that the vertical dimension of the cross piece is less than the thickness of foot board F. By way of example, pallet foot boards are typically constructed of 1 inch nominal lumber which has a finished thickness of about 0.75 inch. The vertical dimension or thickness of cross piece 20 is about 0.5–0.625 inches so that the cross piece can freely enter the space between the lower surface of stringer S and the vehicle bed surface on which the lower face of foot board F is supported.

At the outer end of elongate arms 14 and 16, i.e., the ends opposite the ends to which cross pieces 18 and 20 are attached, are overlapping planar portions 38 and 40 each of which is rigid with the respective elongate arm. The overlapping planar portions can be integral with the respective elongate arms or can be riveted or otherwise fastened to the arm. Through suitable bores formed in each of overlapping portions 38 and 40 there is installed a pivot pin 42. As seen in FIG. 4, pivot pin 42 has a head 44 at each end thereof to retain it in place. Circumscribing the pivot pin is a bearing washer 46 which forms a slight gap between the confronting surfaces of planar portions 38 and 40 to facilitate free pivotal movement thereof. Above and below bearing washer 46 in circumscribing relation to pivot pin 42 are bearing sleeves 48 and 50 which facilitate free pivotal movement between the two elongate rigid arms.

Figure 3:
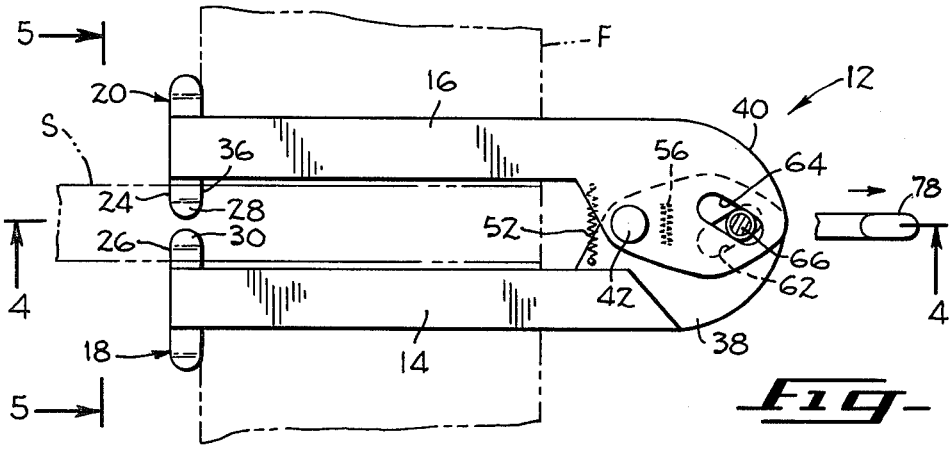
FIG. 3 is a view similar to FIG. 2 showing the pallet puller in a closed position.

Spaced from pivot pin 42 in the direction of the inner ends of arms 14 and 16 is a tension spring 52, the opposite ends of which are hooked to a region of planar portions 38 and 40 adjacent the outer ends of elongate arms 14 and 16. Spring 52 biases the inner ends of arms 14 and 16 inward to the closed position shown in FIGS. 3 and 5. In order to support spring 52 and to protect the same, the confronting surfaces of planar portions 38 and 40 are formed with cylindrical excisions 54 in order that spring 52 is protected and can freely flex during movement of the arms between the open position and the closed position.

Disposed on the side of pivot pin 42 opposite from tension spring 52 is a compression spring 56. The confronting surfaces of planar portions 38 and 40 are formed with semicylindrical depressions 58 that define a chamber in which spring 56 is disposed. Springs 52 and 56 function to bias arms 14 and 16 toward the closed position of FIG. 2. Also urging the arms toward the closed position is a camming arrangement indicated generally at 60.

Camming mechanism 60 includes an obliquely extending elongate slot 62 formed in planar portion 38 and a similar shaped and oriented elongate slot 64 formed in planar portion 40. Extending through slots 62 and 64 is a camming pin 66. Camming pin 66 has an enlarged head 68 at each end thereof and has a bearing washer 70 which circumscribes the camming pin at its midpoint. Bearing washer 70 has the same thickness as bearing washer 46 and supports planar portions 38 and 40 in spaced apart relation and facilitates relative movement of the planar portions. Circumscribing the camming pin in an upper bearing sleeve 72 and a lower bearing sleeve 74 which have outside diameters corresponding to the width of slots 62 and 64 so as to facilitate movement of the camming pin within the slots.

Pin 66 has portions that extend exterior of planar portions 38 and 40 and engage a clevis 76 at the outer end of which is a hook 78. As can be appreciated from FIGS. 2 and 3, the inner extremities of cam slots 62 and 64 register with one another when arms 14 and 16 are in the open position and portions of the slots remote from the inner end register when the arms are in the closed position. Force on hook 78 in the direction of the arrow of FIG. 3 moves camming pin 66 to the position shown in that Figure and urges arm 14 and 16 toward a closed position.

Figure 2:
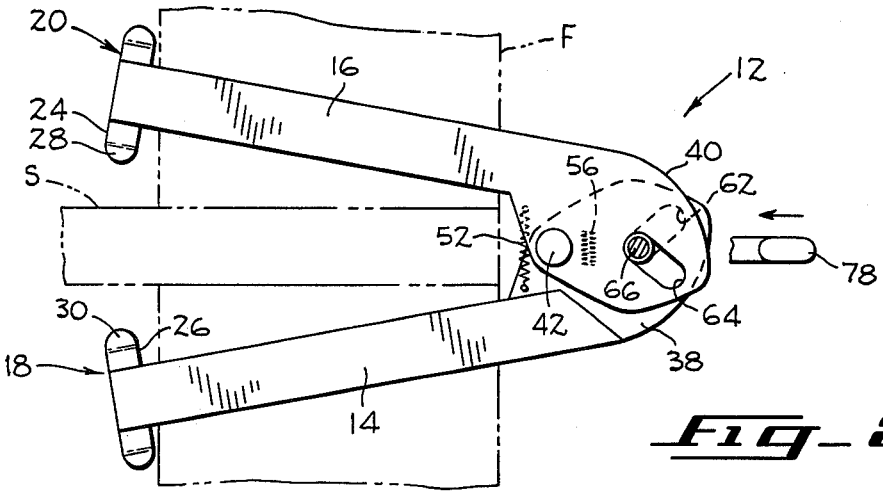
FIG. 2 is a top view of the pallet puller of FIG. 1 in an open position.

In operation, the embodiment of the invention shown in FIGS. 1–5 can be moved to the open position either by grasping arms 14 and 16 and spreading them away from one another and/or moving clevis 76 inward in the direction indicated by the arrow in FIG. 2. With the device in the open position, it is slid into the space between foot board F and load supporting board L with arms 14 and 16 astraddle stringer S. The apparatus is manipulated until cross pieces 18 and 20 enter gap G and surfaces 22 of the arms rest on the upper surface of foot board F. Next the apparatus is moved to the closed position of FIG. 3 by pushing arms 14 and 16 toward one another and/or by moving clevis 76 outward in the direction of the arrow of FIG. 3. Tapered surfaces 28 and 30 on the upper surfaces of lateral projections 24 and 26 of the cross pieces facilitate movement of the device to the closed position. Springs 52 and 56 also facilitate movement to the closed position, and when the device reaches the closed position of FIG. 3 the springs there retain it. Even before tension is applied to hook 78 the device is securely engaged with the pallet because projections 24 and 26 of the cross pieces underlie stringer S. A chain or cable can be conveniently attached to hook 78 so that tension applied to the chain or cable skids the pallet over the surface of the vehicle bed to a point sufficiently close to a door that a fork lift truck can engage the pallet. When the pallet reaches such position the chain or cable is disconnected from hook 78 and inward pressure on the hook and on clevis 76 moves camming shaft 66 from the position shown in FIG. 3 to the position shown in FIG. 2, which in turn causes the device to move to the open position of FIG. 2. In the open position removal of the device is easily accomplished.

Because the upper surfaces of cross pieces 18 and 20 are engaged beneath stringer S, hook 78 is supported at all times above the lower surface of foot board F and above the bed surface of the vehicle. Accordingly, the pallet can be skidded over the bed surface without any interference whatsoever from the apparatus. Also contributing to the freedom from interference is the fact that cross pieces 18 and 20 have a vertical dimension less than the thickness of foot board F so that the lower surfaces of the cross pieces do not contact the vehicle bed surface.

An alternate and simplified form of the present invention is shown in FIG. 6. There is an elongate rigid arm 14' to the inner end of which is fixed a cross bar 18'. Cross bar 18' has a lateral projection 26' extending from one side thereof and a lateral projection 80 extending from the other side. Arm 14' has a surface (not shown) that is equivalent to surface 22 of arms 14 and 16 to which cross piece 18' is attached. The upper surface of the cross piece is coextensive with such surface so that the cross piece can fit beneath stringer S'. On the outer end of rigid arm 14' is secured a hook 78' for effecting engagement with the device by a chain or cable.

Operation of the modification of FIG. 6 proceeds by introducing the device into the pallet space between the foot board and the load supporting board until cross piece 18' drops into gap G. The device is then slid laterally until lateral projection 26' is positioned beneath stringer S. The device will there be retained until tension is applied to a cable or chain engaged with hook 78'. Because cross piece 18' is symmetrical, the apparatus can be placed on the side of stringer S opposite from that shown in FIG. 6, in which case lateral projection 80 will fit beneath the stringer. As in the case of the embodiment described hereinabove in connection with FIGS. 1-5, the embodiment of FIG. 6 is arranged to avoid contact with the vehicle bed surface over which the pallet is skidded. More particularly, the vertical dimension of cross piece 18' is less than that of foot board F, and the fact that the cross piece fits beneath the stringer prevents hook 78' from contacting the vehicle bed surface.

Cross pieces 18, 20 and 18' can be formed with a smooth vertical bearing edge 36 seen in FIG. 4. Alternatively, the cross pieces can have bearing surfaces configured as shown in FIGS. 7 and 8. In FIG. 7 there is shown a cross piece **18*a* secured on the lower surface of a rigid elongate arm 14*a*. The bearing surface of the cross piece, that is, the surface that contacts the rear edge surface of foot board F is tapered from a lower edge 82 in a direction toward the inner end of arm 14*a* to an upper edge 84. A weldment 86 is provided for retaining the cross piece to the elongate arm, the dimension of the weldment in a direction longitudinally of arm 14*a* being less than the amount of taper. The construction shown in FIG. 7 affords two advantages: (1) edge 82 partially penetrates the edge surface of foot board F so as to enhance engagement between the apparatus and the pallet, and (2) weldment 86** can be formed without producing a protrusion that would prevent firm engagement between the cross piece and the inner edge of foot board F.

Another alternate form for the cross piece is shown in FIG. 8. In FIG. 8 there is a rigid elongate arm **14*b* and a cross piece 18*b*. The bearing surface of cross piece 18*b* has a series of serrations 88 at the portion thereof remote from arm 14*b*. The bearing surface tapers upward and inward to a point 90 at which a weldment 92 can be provided. As in the case of the embodiment of FIG. 7, weldment 92 is totally inward, i.e., leftward as viewed in FIG. 8, of the serrations 88 so that the weldment does not interfere with engagement between the serrations and the inner edge of foot board F. It will be noted that the vertical extend of cross piece 18*b*** is less than the thickness of foot board F so that the cross piece does not interfere with movement of the pallet over the vehicle bed surface.

Thus it will be seen that the present invention provides a pallet puller which can be quickly installed on a pallet and which is virtually immune to inadvertent dislodgement from the pallet. The pallet puller can be quickly removed from engagement with the pallet, however, when such is desired. Additionally, a pallet puller according to the present invention does no significant damage to the pallet. Finally, the pallet puller can be securely installed in a manner where it is spaced above the surface on which the pallet is supported so as to avoid interference when the pallet is skidded over the vehicle bed surface.

Although several embodiments of the invention have been shown and described, it will be obvious that other adaptations and modifications can be made without departing from the true spirit and scope of the invention.

What is claimed is:

1. A pallet puller for engaging a pallet of the type that includes a plurality of foot boards having a given thickness and an upper surface, a plurality of stringers extending transversely of said foot board and secured thereto, said stringers each having a lower surface that abuts the upper surfaces of said foot boards on a plane, and a plurality of load supporting boards mounted on the upper side of said stringers opposite said foot boards, said stringers having a thickness so as to define a space between said foot boards and said load supporting boards that corresponds to said thickness of said stringers, one of said foot boards being an edge foot board and having an outer edge surface coextensive with a peripheral edge of the pallet and an inner edge surface interior of said outer edge surface and spaced apart from the next adjacent foot board by a gap, said pallet puller comprising an elongate rigid arm sized to fit into said space and having an inner end and an outer end, said elongate rigid arm having a support surface adapted to reside upon the upper surface of said edge board, a cross piece secured to said support surface adjacent said inner end and having a gripping projection protruding downward from said support surface and laterally outward of said arm so that said projection resides on or below said support surface, said gripping projection having a thickness less than said given thickness of said foot board so that said gripping projection can be disposed within said gap beneath said plane and said stringer in engagement with the inner edge surface of said foot board, and means on the outer end of said arm for effecting engagement with said arm.

2. A pallet puller according to claim 1 wherein said cross piece projection has a gripping surface engagable with the inner edge surface of said foot board, said gripping surface being substantially perpendicular to said support surface.

3. A pallet puller according to claim 1 wherein said cross piece has a gripping surface that includes a bevelled surface, the portion of said bevelled surface adjacent said support surface being more remote from said outer end of said arm than the portion of said bevelled surface remote from said support surface.

4. A pallet puller according to claim 1 wherein said cross piece has a gripping surface that includes a plurality of serrations which define ridges for at least partially penetrating the inner edge surface of said foot board.

5. A pallet puller according to claim 1 wherein the extremity of said cross piece remote from said rigid elongate arm is tapered to facilitate insertion thereof beneath said stringer in said gap.

6. A pallet puller according to claim 1 in combustion with a second rigid elongate arm substantially equivalent to first said rigid elongate arm, said second elongate arm having an outer end, means for pivotally joining the outer ends of said elongate arms, said second elongate arm having an inner end, a second cross piece substantially equivalent to first said cross piece secured to the inner end of said second elongate arm, said cross pieces extending from respective said rigid elongate arms by a distance no greater than the width of said stringers, and means adjacent said outer ends and operatively associated with said pivotally joining means for urging said arms and cross pieces toward one another in said gap beneath said stringer.

7. A pallet puller according to claim 6 wherein said outer ends have planar overlapping portions, wherein said pivotally joining means include a pivot pin extending through said planar overlapping portions, and wherein said urging means includes a tension spring extending between said rigid elongate arms on a side of said pivot pin toward said inner ends.

8. A pallet puller according to claim 6 wherein said outer ends have planar overlapping portions, wherein said pivotally joining means include a pivot pin extending through said planar overlapping portions, and wherein said planar overlapping portions each have a confronting surface outward of said pivot pin, said confronting surfaces having depressions that coact to define a spring chamber, and a compression spring disposed in said spring chamber so as to bias the inner ends of said elongate arms toward one another.

9. A pallet puller according to claim 6 wherein said outer ends have planar overlapping portions, wherein said pivotally joining means includes a pivot pin extending through said planar overlapping portions, and wherein said planar overlapping portions each have a confronting surface inward of said pivot pin, said confronting surfaces have depressions that coact to define a spring chamber, and a tension spring disposed in said spring chamber so as to bias the inner ends of said elongate arms toward one another.

10. A pallet puller according to claim 6 wherein said outer ends have planar overlapping portions, wherein said pivotally joining means include a pivot pin extending through said planar overlapping portions, and wherein said planar overlapping portions each define an elongate camming slot, said camming slot being disposed outward of said pivot pin and being positioned and dimensioned so that inner portions of respective said camming slots are in registry when said rigid elongate members are in an open position, said camming slots having outer portions that are in registry when said rigid elongate members are in the closed position, said engagement effecting means including a camming pin extending through said camming slots so as to urge said rigid elongate members toward the closed position in response to tension on said engagement effecting means and means for attaching a tension member to said camming pin, said camming slots having a substantially uniform width throughout their lengths, said camming pin having a cross-sectional dimension corresponding to said uniform width so that movement of said pin toward the inner ends of said rigid arms urges said cross pieces away from one another.

11. A pallet puller according to claim 10 wherein said tension member attaching means includes a clevis having an inner end engaged with said camming pin, said clevis having a remote end remote from said inner end, and a hook attached to said remote end.

* * * * *